US007275603B2

(12) United States Patent
Polan

(10) Patent No.: US 7,275,603 B2
(45) Date of Patent: Oct. 2, 2007

(54) CONCEALED PENDENT FIRE PROTECTION SPRINKLER WITH DROP-DOWN DEFLECTOR

(75) Inventor: George S. Polan, Greer, SC (US)

(73) Assignee: The Reliable Automatic Sprinkler Co., Inc., Mount Vernon, NY (US)

( * ) Notice: Subject to any disclaimer, the term of this patent is extended or adjusted under 35 U.S.C. 154(b) by 297 days.

(21) Appl. No.: 10/974,106

(22) Filed: Oct. 26, 2004

(65) Prior Publication Data

US 2006/0102362 A1 May 18, 2006

(51) Int. Cl.
*A62C 37/08* (2006.01)

(52) U.S. Cl. ..... 169/37; 169/38; 169/39; 169/40; 169/41

(58) Field of Classification Search ..... 169/37, 169/38, 40, 33, 41, DIG. 3, 39, 79, 51, 90; 239/498, 504
See application file for complete search history.

(56) References Cited

U.S. PATENT DOCUMENTS

| | | | | | |
|---|---|---|---|---|---|
| 437,846 | A | * | 10/1890 | Kehr | 169/40 |
| 1,422,875 | A | * | 7/1922 | Madigan | 169/41 |
| 2,558,450 | A | | 6/1951 | Martin | 169/37 |
| 3,714,989 | A | * | 2/1973 | Gloeckler | 169/19 |
| 4,014,388 | A | * | 3/1977 | Anderson | 169/37 |
| 4,105,076 | A | * | 8/1978 | Simons et al. | 169/40 |
| 4,491,182 | A | * | 1/1985 | Pieczykolan | 169/38 |
| 4,508,175 | A | * | 4/1985 | Pieczykolan | 169/38 |
| 4,880,063 | A | * | 11/1989 | Leininger et al. | 169/37 |
| 4,926,946 | A | * | 5/1990 | Polan | 169/37 |
| 4,938,292 | A | * | 7/1990 | Johnson | 169/19 |
| 4,976,320 | A | * | 12/1990 | Polan | 169/39 |
| 5,080,176 | A | * | 1/1992 | Polan et al. | 169/37 |
| 5,083,616 | A | | 1/1992 | Polan | 169/40 |
| 5,097,906 | A | * | 3/1992 | Polan | 169/37 |
| 5,152,344 | A | * | 10/1992 | Fischer et al. | 169/37 |
| 5,234,059 | A | | 8/1993 | Eynon | 169/39 |
| 5,299,645 | A | | 4/1994 | Hoening et al. | 169/39 |
| 5,494,114 | A | | 2/1996 | Hoening et al. | 169/38 |
| 5,664,630 | A | * | 9/1997 | Meyer et al. | 169/37 |
| 6,123,153 | A | | 9/2000 | Finnegan | 169/37 |
| 6,230,815 | B1 | * | 5/2001 | Sundholm | 169/37 |
| 6,296,062 | B1 | * | 10/2001 | Sundholm | 169/37 |

(Continued)

FOREIGN PATENT DOCUMENTS

GB 2155328 A * 9/1985

OTHER PUBLICATIONS

"Series LFII Residential Concealed Pendent Sprinkler, Flat Plate, 4.2 K-Factor," Tyco Fire Products, Lansdale, PA, Jul. 2002.

*Primary Examiner*—Dinh Q. Nguyen
*Assistant Examiner*—Trevor McGraw
(74) *Attorney, Agent, or Firm*—Fitzpatrick, Cella, Harper & Scinto

(57) ABSTRACT

A fire protection sprinkler is provided, including a body having an output orifice and a flange and a seal cap to seal a flow of fluid from the output orifice. A thermally-responsive element is positioned to releasably retain the seal cap. Housing members extend through and from the flange of the sprinkler body, and contain rods, each of which extends through the flange. A deflector is connected to ends of the rods.

11 Claims, 7 Drawing Sheets

U.S. PATENT DOCUMENTS 6,345,670 B1 * 2/2002 Sundholm ..... 169/37
2002/0088624 A1 * 7/2002 Waligorski ..... 169/38
2002/0148620 A1 * 10/2002 Polan ..... 169/38

* cited by examiner

CONCEALED PENDENT FIRE PROTECTION SPRINKLER WITH DROP-DOWN DEFLECTOR

BACKGROUND OF THE INVENTION

1. Field of the Invention

The present invention relates to a pendent fire protection sprinkler with a drop-down deflector. The present invention further relates to concealed pendent sprinklers for residential applications.

2. Related Art

Fire protection sprinklers conventionally are connected to a conduit to receive pressurized fire-extinguishing fluid, such as water. A typical sprinkler has a base with a threaded portion for connection to the conduit and an output orifice to output the fluid to provide fire control and/or suppression. The output orifice is sealed by a seal cap, which is held in place by a release mechanism. The release mechanism is designed to release the cap under predetermined conditions, thereby initiating the flow of fire-extinguishing fluid. A typical release mechanism includes a thermally-responsive element, e.g., a frangible bulb or a fusible link, and may include a latching mechanism.

A sprinkler may be mounted on a fluid conduit running along a ceiling and may either depend downward from the conduit, which is referred to as a "pendent" configuration, or may be mounted on a wall, a certain distance below the ceiling, which is referred to as a "horizontal sidewall" configuration.

Certain conventional sprinklers have a pair of arms that extend from a base, wherein the arms connect at a hub. The hub is spaced apart from the output orifice of the base and is aligned with a longitudinal axis thereof. The hub may have a set-screw configured to apply a force to the thermally-responsive element and latching mechanism thereby maintaining the seal cap in a position which seals the output orifice. A deflector may be mounted on the hub, transverse to the output orifice, to provide dispersion of the output fluid.

Other sprinklers have a deflector that is attached by a pair of arms that extend from the base of the sprinkler, but do not meet at a hub. In such sprinklers, the thermally-responsive element holds the seal cap in place without being held in compression by a hub. For example, U.S. Pat. No. 4,976,320 shows a sprinkler having a deflector attached to the body with arms that do not meet at a hub. The arms extend from the sprinkler body, and a drop-down deflector is attached to the sprinkler via two guide pins, which are installed in holes in a bent portion at the bottom of each arm. U.S. Pat. No. 5,664,630 shows another example of a sprinkler with a drop-down deflector.

SUMMARY OF THE INVENTION

In one aspect, the present invention provides a fire protection sprinkler, including a body having an output orifice and a flange, a seal cap to seal a flow of fluid from the output orifice, and a thermally-responsive element positioned to releasably retain the seal cap. Housing members extend from the flange, and rods are slidably contained within the housing members and extend into the flange. A deflector is connected to ends of the rods.

Embodiments of the present invention may include one or more of the following features. The thermally-responsive element may include a pair of levers, each of which is connected to a plate of a soldered link. The rods may slide between a first position within the housing member, to a second, lower position extending from the housing member. In the second position, the rods may engage the housing members so as to assist in maintaining the deflector in a relatively stable position. Each of the rods may have at least one cylindrical portion and at least one frustoconical portion. Each of the housing members also may have at least one cylindrical portion and at least one frustoconical portion. The frustoconical portion of the rod may lodge in a frustoconical portion of the housing member.

The deflector may include a conical portion facing the output orifice and radial slots. At least two sides of the deflector may be substantially linear. The deflector may include tab portions with holes configured to receive ends of the rods, to connect the deflector to the rods.

Embodiments may further include a support cup having a substantially cylindrical outer surface, wherein the sprinkler is mounted in the support cup. A height of the outer surface of the support cup in an axial direction may be less than a length of the rods. A substantially cylindrical escutcheon having a flange may be installed in the support cup so as to surround the sprinkler. A substantially flat cover may be releasably mounted on the flange of the escutcheon. The deflector may move from a first position to a second, lower position upon release of the cover.

In another aspect, the present invention provides a fire protection sprinkler, including a body having an output orifice and a flange, a seal cap to seal a flow of fluid from the output orifice, and a thermally-responsive element positioned to releasably retain the seal cap. The sprinkler further includes deflector support members extending from the flange and a deflector connected to the deflector support members. In embodiments of this aspect, the deflector support members may extend through the flange.

In another aspect, the present invention provides a fire protection sprinkler, including a body having an output orifice and a flange, a seal cap to seal a flow of fluid from the output orifice, and a thermally-responsive element positioned to releasably retain the seal cap. The sprinkler further includes deflector support members having movable portions configured to move from a first position to a second position. A deflector is connected to the movable portions of the deflector support members. In the first position, the movable portions of the deflector support members are within the flange, and in the second position, the movable portions of the deflector support members are in a lower position, below the flange.

These and other objects, features and advantages will be apparent from the following description of the preferred embodiments of the present invention.

BRIEF DESCRIPTION OF THE DRAWINGS

The present invention will be more readily understood from a detailed description of the preferred embodiments taken in conjunction with the following figures.

DETAILED DESCRIPTION OF THE PREFERRED EMBODIMENTS

Figure 1:
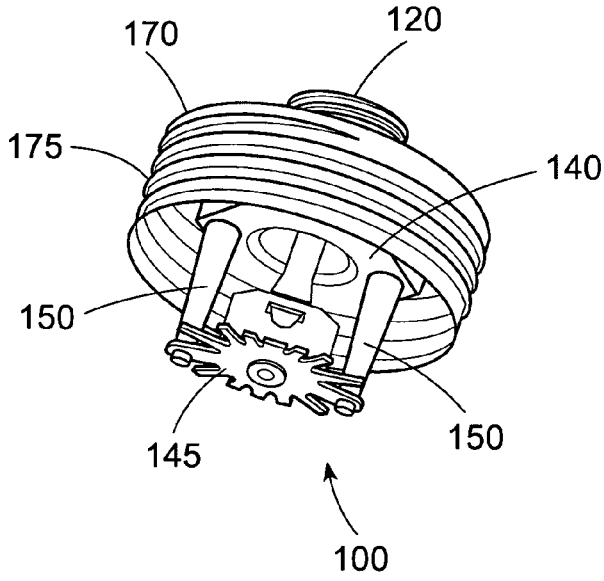
FIG. 1 is an isometric view of the pendent fire protection sprinkler of the present invention.
Figure 2:
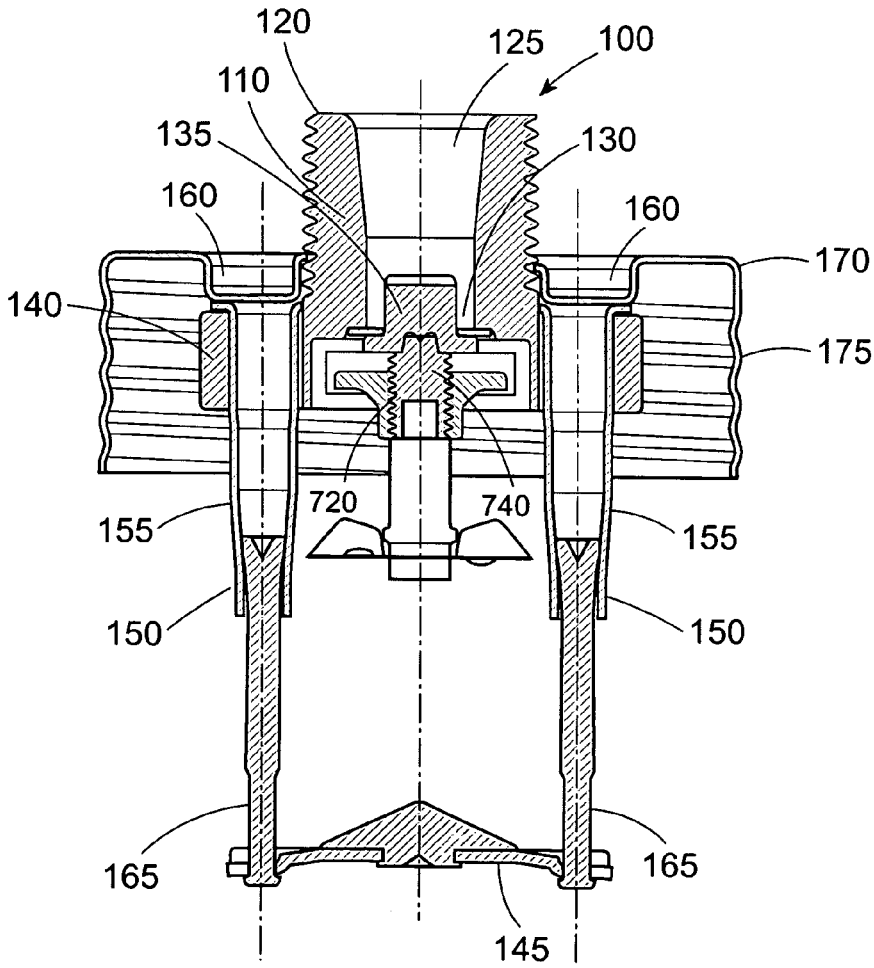
FIG. 2 is a sectional view of the sprinkler installed in the support cup, with the deflector in the deployed position.

As shown in FIGS. 1 and 2, a pendent fire protection sprinkler 100 in accordance with the present invention has a body 110 with a threaded base 120 for connection to a conduit (not shown) for supplying pressurized fire-extinguishing fluid, such as water. The body 110 has an axial bore 125 with an outlet orifice 130 from which the fluid is output upon release of a seal cap 135. The output orifice 130 may have a diameter of, for example, ⅜ or 7/16 inch. The sprinkler may have a nominal K-factor of, for example, 4.3 or 5.6, respectively, which is defined by $K=Q/\sqrt{p}$, where Q is the flow rate in gallons per minute and p is the residual pressure at the inlet of the sprinkler in pounds per square inch. The body 110 also has a hexagonal flange 140 around its output end.

A deflector 145 is coupled to two deflector support members 150 on opposite sides of the sprinkler body 110. Each of the support members 150 includes a housing member 155, which extends downward from the flange 140 of the sprinkler body 110, and a rod 165, which is movable with respect to the housing member 155.

Figure 8:
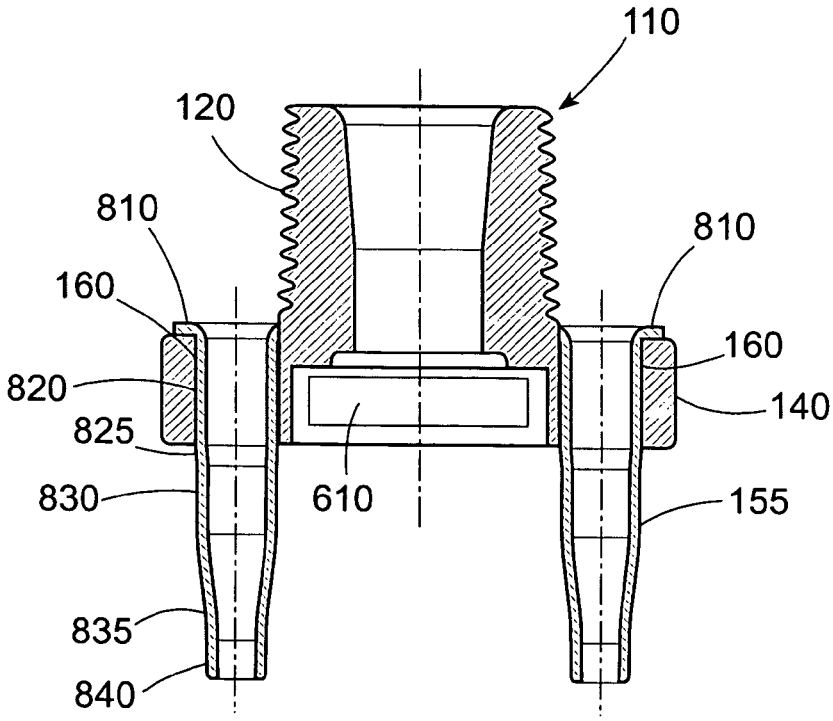
FIG. 8 is a sectional view of the sprinkler body showing the housing members of the deflector support members.
Figure 9:
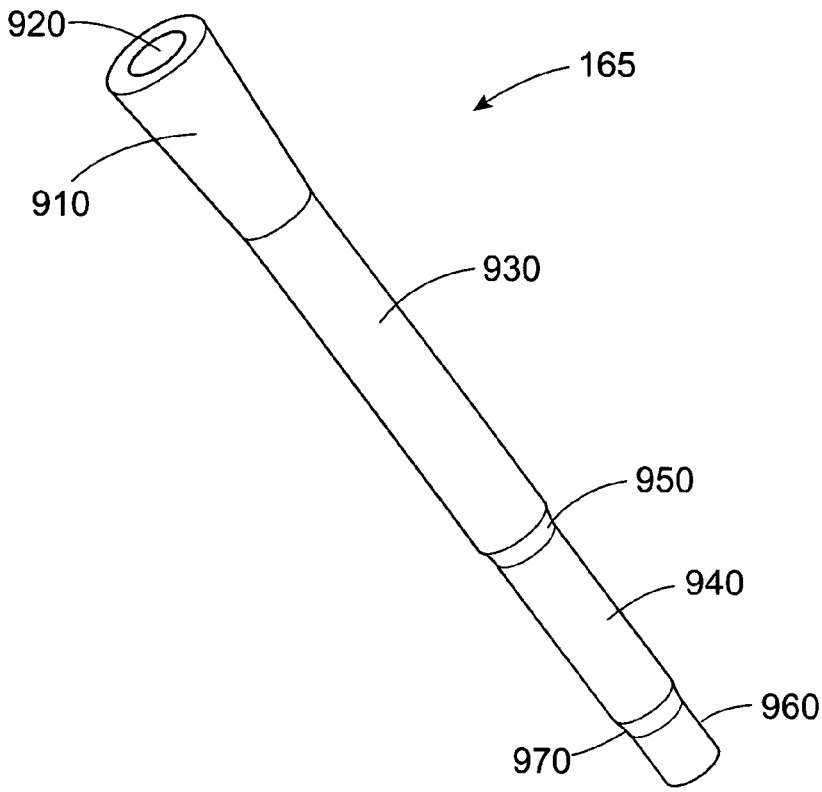
FIG. 9 is an isometric view of a rod that forms part of the deflector support member.

For example, the housing member 155 may be a tubular structure positioned within and extending downward from a hole 160 in the flange 140, and the rod 165 may be a solid, generally cylindrical member contained within the housing member 155. However, numerous other configurations for the housing members 155 and rods 165 also are possible. For example, the rods 165 may be tubular members, rather than solid members. Although the configuration of the preferred embodiment of the housing members 155 and rods 165 are shown in FIGS. 8 and 9, other shapes are possible as well, e.g., square, hexagonal, cylindrical, telescopic, etc. In addition, although in the preferred embodiment the flange 140 and housing members 155 are separate components, the present invention is not so limited, and those components may be configured as a unitary structure or having multiple components.

During operation, the rods 165 slide from an initial position, in which a large portion of the length of the rod 165 is within the housing member 155 (as shown in FIG. 1) to a deployed position, in which a substantial portion of the length of the rod 165 extends from the bottom of the housing member 155 (as shown in FIG. 2). Accordingly, in the deployed position, the deflector 145 moves downward along with the rods 165 (see FIG. 2).

The sprinkler 100 is mounted in a support cup 170 having a cylindrical, threaded outer wall 175, which surrounds a portion of the installed sprinkler 100 and, as discussed below, allows for installation into a ceiling cavity. The support cup 170 also has a mounting platform 305 (see FIG. 3) with a hole in the center into which the sprinkler body 100 is inserted. The hole has a threaded rim portion 310 or tabs configured to interlock with the threads of the sprinkler base 120.

Figure 3:
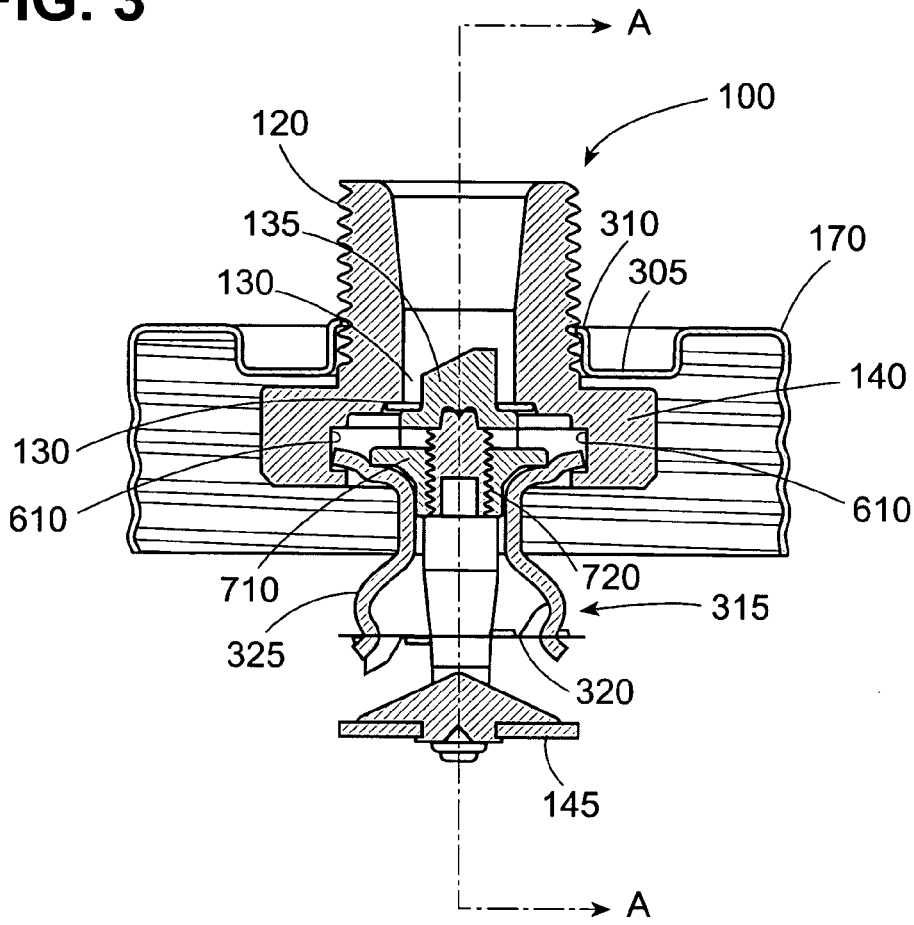
FIG. 3 is a sectional view of the sprinkler and support cup, showing the levers and fusible link.
Figure 4:
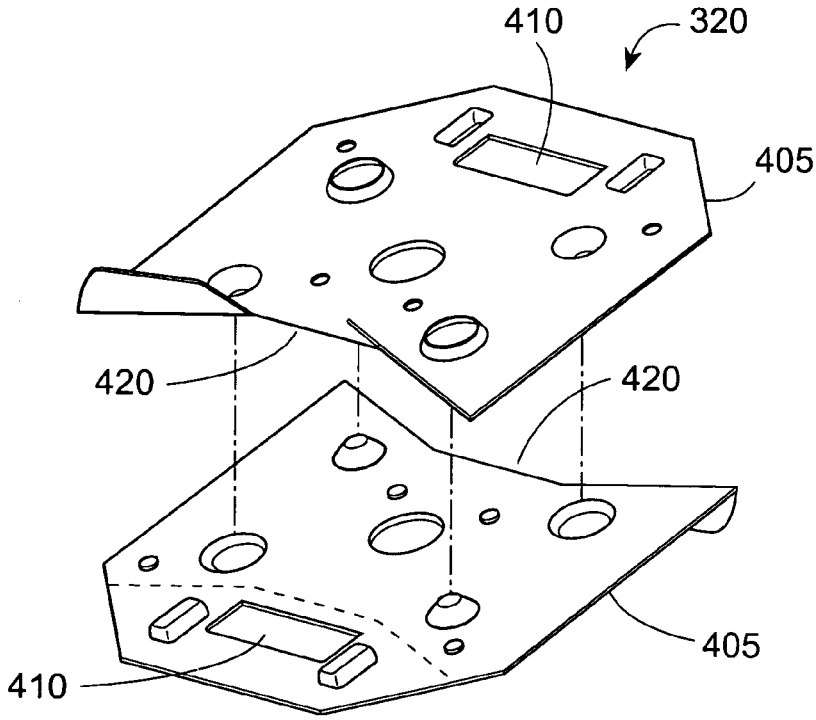
FIG. 4 is an isometric view of the fusible link.

As shown in FIG. 3, the sprinkler also has a thermally-responsive element 315 that holds the seal cap 135 in place over the output orifice 130, e.g., a fusible soldered link 320 attached to the ends of two levers 325. As shown in FIG. 4, the link 320 comprises two thin, metal plates 405, e.g., beryllium-nickel alloy. The plates 405 overlap such that a rectangular opening 410 in each plate 405, in which the ends of the levers 325 are positioned, is aligned with a slot 420 or open portion in the other plate 405. The plates 405 are attached with solder that melts at a predetermined temperature. The link 320 separates at the predetermined temperature, due to the force applied by the levers 325, allowing the levers 325 to swing outward (FIG. 3). This in turn releases the seal cap 135 and allows the fluid to be output from the orifice 130. Of course, other types of thermally-responsive elements may be used, including, but not limited to, for example, a frangible bulb and lever assembly, or a sensor, strut, and lever assembly.

Figure 5:
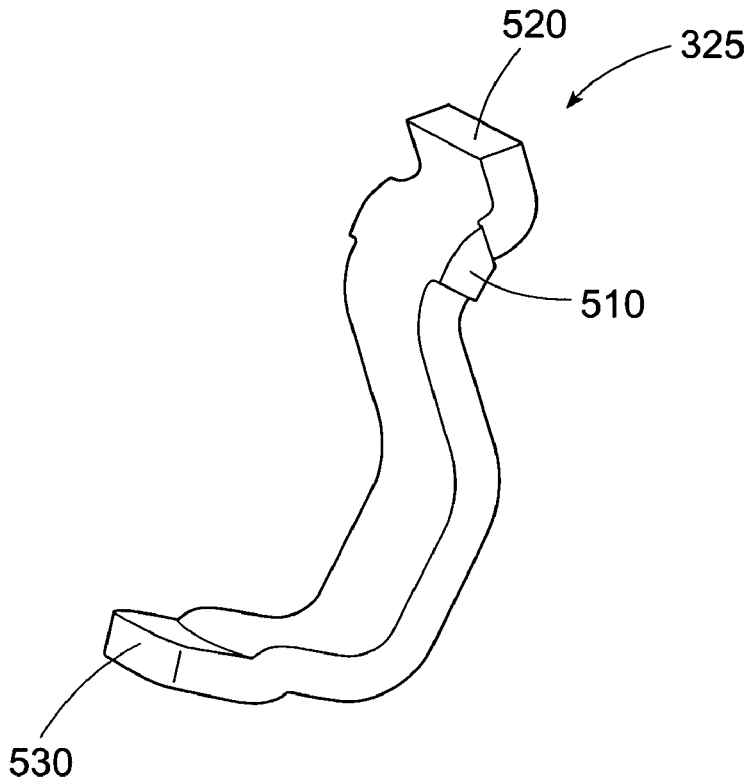
FIG. 5 is an isometric view of a lever.
Figure 6:
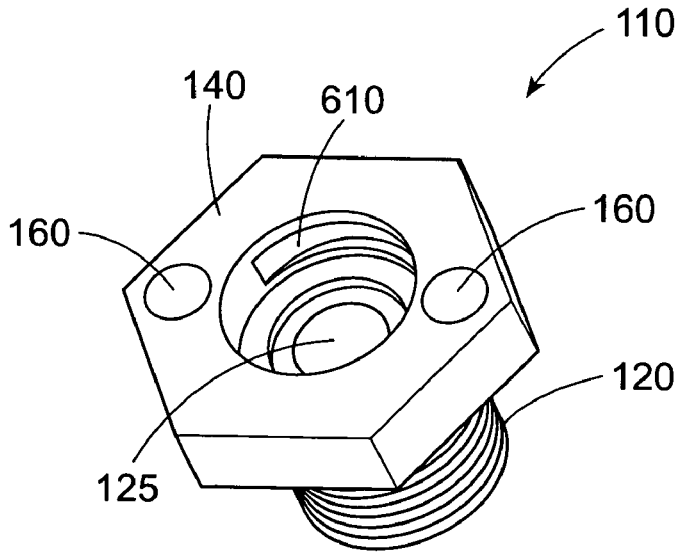
FIG. 6 is an isometric view of the underside of the sprinkler body.

Each lever, as shown in FIG. 5, is an elongated, thin, metal member, e.g., copper alloy with a thickness of 0.050 inches. Each lever 325 has a wider tab portion 510 located near the end 520 that inserts into one of the openings 410 in the link plates 405. The tab portion 510 rests against the plates 405, so as to maintain the position of the lever 325 with respect to the plates 405. The other end 530 of each lever 325 is inserted into one of a pair of arcuate, rectangular slots 610, as shown in FIG. 6, formed inside the bore 125 on either side of the outlet orifice. The slots 610 are positioned 90° apart from the deflector support members 150 in the plane of the flange 140.

Figure 7:
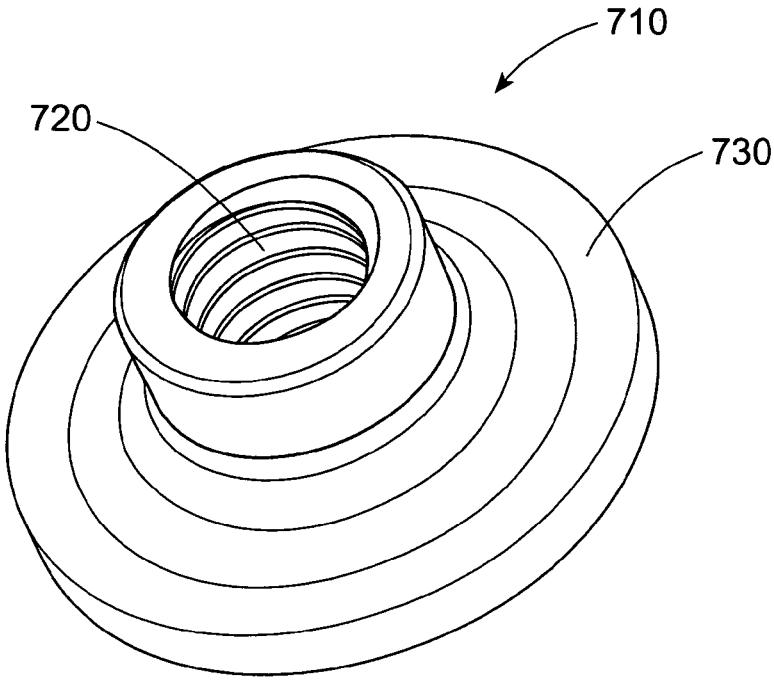
FIG. 7 is an isometric view of the load yoke.

Referring again to FIG. 3, the levers 325 swing outward upon release of the fusible link 320 due to the force of the fluid in the conduit against the seal cap 135 and a pre-tension force supplied by a loading yoke 710, as shown in FIG. 7. The loading yoke 710 is a cylindrical member with a threaded bore 720 and a circumferential flange 730 at one end. A load screw 740 (see FIG. 3) extends completely through the bore 720 of the yoke 710 and rests in an indentation in the seal cap 135. The yoke 710 is forced against the levers 325 by the tightening of the load screw 740 against the seal cap 135, thereby forcing the levers 325 away from one another.

As shown in the cross-sectional view of FIG. 8, the housing members 155 of the deflector support members 150 are positioned in through-holes 160 formed in the flange 140 of the sprinkler body 110, such that their axes are spaced apart by about 1.125 inches. Each housing member 155 is about 1.13 inches in length and is formed of thin metal, e.g., copper alloy. The top end of each housing member 155 has a flange 810 to hold it in place. The outer perimeter of this flange 810 is circular, with a cutout to allow the housing member 155 to be positioned closer to the sprinkler body 110.

At the top of each housing member 155 (i.e., the flanged end) is a first cylindrical portion 820, which is about 0.35 inches in length and about 0.26 inches in diameter. This is followed by a first frustoconical portion 825 having a length of 0.08 inches and forming an angle of about 8.0° with respect to the longitudinal axis of the housing member. A second cylindrical portion 830 adjoins, with a diameter of about 0.25 inches and a length of 0.20 inches. This is followed by a second frustoconical portion 835 having a length of 0.35 inches and forming an angle of about 8.6° with respect to the axis of the housing member. A third cylindrical portion 840 is provided at the end of the housing member 155, which has a length of about 0.11 inches and a diameter of about 0.2 inches.

As shown in FIG. 9, the rods 165 of the deflector support members 150, which slide between a position within the housing members 155 and an extended position, are each about 1.28 inches in length. Each rod 165 has a frustoconical portion 910 at the top, which is about 0.29 inches in length and forms an angle of about 4.5° with respect to the longitudinal axis of the rod. The diameter of the frustoconical portion 910 is about 0.155 inches at the top end and about 0.11 inches at the bottom end.

A conical void 920, which has a length of about 0.07 inches, an opening diameter of about 0.85 inches is formed in the end of the rod 165. The conical void 920 aids in material flow during the formation of the frustoconical portion 910 of the rod 165. The frustoconical portion 910 helps hold the rod 165 in rigid position at the bottom of the housing member 155 in the deployed position. While in the preferred embodiment the rod has a void in an end thereof, the present invention is not limited to this configuration and may include solid rods without a void or indentation, or hollow rods.

The frustoconical portion 910 is followed by a first cylindrical portion 930 of about 0.56 inches in length and a diameter of about 0.11 inches. A second cylindrical portion 940 of about 0.30 inches in length and about 0.93 inches in diameter is formed, and the top end of this portion blended to the surface of the first cylindrical portion by a curved surface 950 having a radius of 0.08 inches. A third cylindrical portion 960 having a length of about 0.115 inches and a diameter of about 0.082 inches is formed at the bottom of the rod 165. The surface of the third cylindrical portion 960 is blended to the surface of the second cylindrical portion 940 by a curved surface 970 having a radius of about 0.08 inches.

When the sprinkler is deployed (see FIG. 2), the first frustoconical portion 910 of the rod 165 lodges in the second frustoconical portion 835 and third cylindrical portion 840 of the housing member. By using the above described configuration, the deflector is more stable when deployed, allowing for a consistent sprinkler spray pattern. By contrast, without such a configuration, the force of the fluid output may cause the deflector to wobble or shift to, and possibly jam in, an askew position, resulting in an undesirable spray pattern.

The stability of this configuration is in part attributed to the resiliency in the first frustoconical portion 910 of the rod 165, which provides a substantially locking fit between the rod 165 and the housing member 155. This in turn provides stability to the deployed deflector 145 when it is exposed to the stream of output fluid, thereby preventing undesirable vibration or movement of the deflector 145. While this is the preferred embodiment, the invention is not limited to this particular configuration, and may include other deflector support members.

Figure 10:
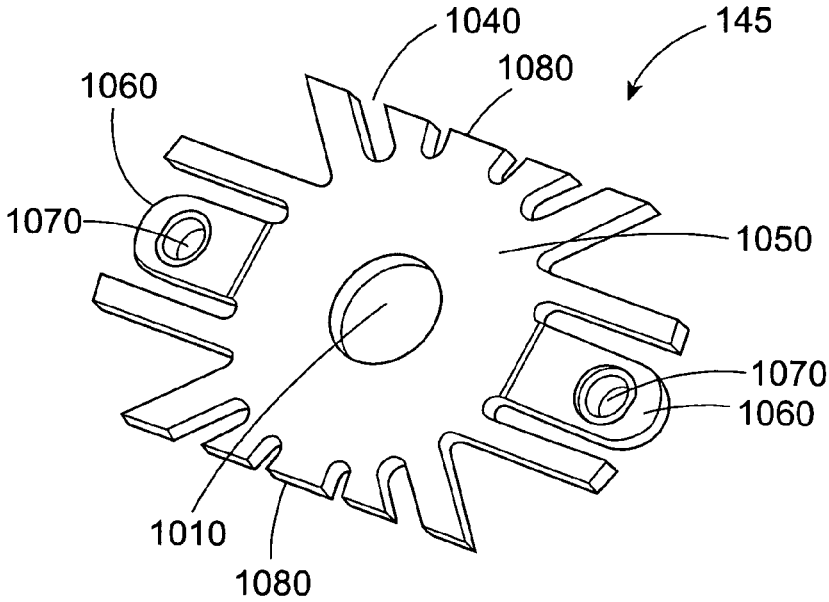
FIG. 10 is an isometric view of the deflector.
Figure 11:
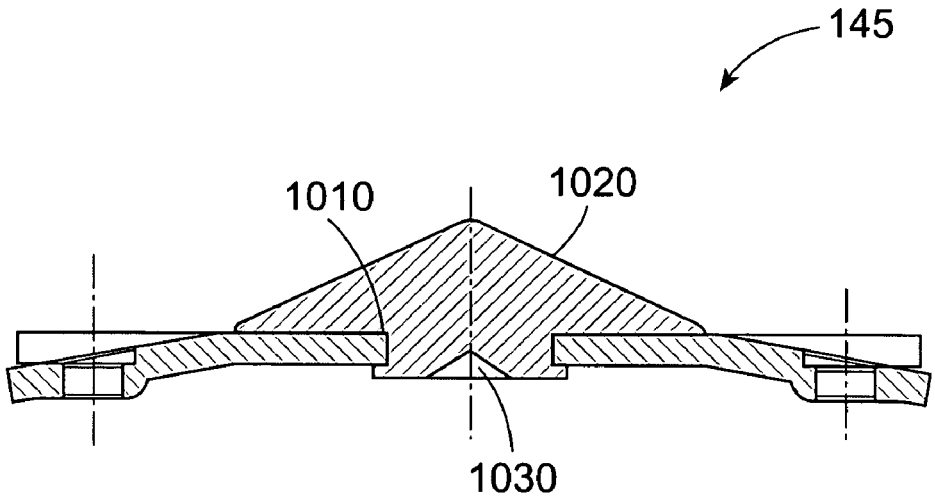
FIG. 11 is a sectional view of the deflector and the conical member.

The deflector 145, which is shown in detail in FIGS. 10 and 11, has an opening 1010 in the middle that is configured to receive a conical member 1020. The conical member 1020, which has an outer diameter of 0.7 inches and an included angle of 130°, faces the output orifice 130 to assist in the dispersion of the output fluid and to improve the stability of the deployed deflector 145. A conical indentation 1030 having an included angle of about 118° to about 120° is formed in the base of the conical member 1020 (which has a diameter of 0.245 inches) to allow it to achieve a secure press fit in the opening 1010 of the deflector 145. The conical member 1020 also helps prevent the seal cap 135 and other ejected components from becoming lodged behind the deflector 145 upon deployment of the sprinkler.

The deflector 145 has radial slots 1040 around the perimeter thereof, arrayed around the opening 1010 for the conical member 1020. The slots 1040 extend inward to within a distance of the opening 1010 to form a generally circular central portion 1050 of the deflector 145 surface. Two tab portions 1060 extend from the sides of the deflector 145 with a downward angle of about 10° (with respect to the plane of the deflector) to provide mounting holes 1070 for the rods 165 extending from the deflector support members 150. The outer edges 1080 of the other two sides of the deflector are linear (see FIG. 10).

Figure 12:
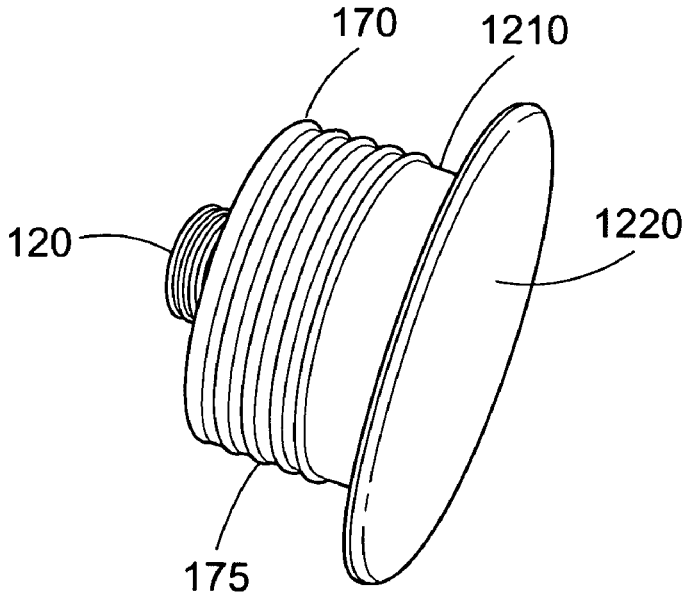
FIG. 12 is an isometric view of the sprinkler installed in the support cup, escutcheon, and cover assembly.
Figure 13:
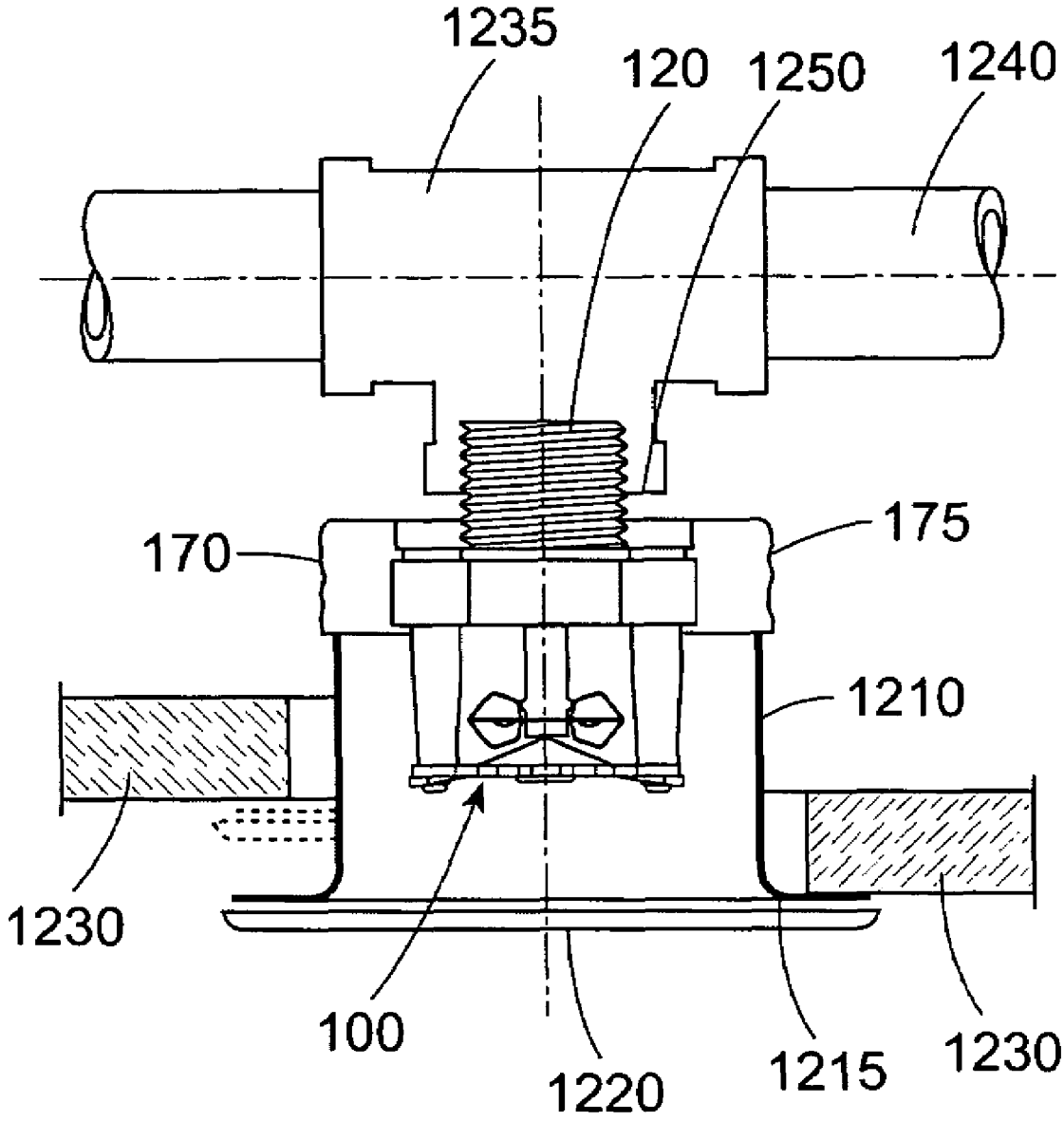
FIG. 13 is a sectional view of the sprinkler installed in a ceiling.

As shown in FIGS. 12 and 13, the sprinkler 100 installs within a support cup 170, escutcheon 1210, and cover 1220 assembly to form a concealed configuration. Such a configuration is particularly desirable for residential application due to its low profile and aesthetically pleasing appearance. The escutcheon 1210, which is cylindrical and has a circumferential flange 1215 on its outwardly facing end, installs with a press or threaded fit into the ridged outer surface (walls 175) of the support cup 170. The escutcheon 1210 is formed of metal, e.g., copper alloy.

A flat, circular cover 1220, which also is formed of metal, e.g., brass, is mounted on raised portions around the periphery of the escutcheon flange 1215 (see FIG. 13). The cover 1220 attaches to these raised portions with solder that is designed to melt at a predetermined temperature, e.g., 135° F., to allow for release of the cover 1220. The raised portions result in a gap between the cover 1220 and the escutcheon 1210, which allows air flow to reach the sprinkler 100. The release of the cover 1220 allows the deflector 145 to drop down into the deployed position. At a second predetermined temperature, e.g., 165° F., the fusible soldered link 320 separates, as described above, to initiate the flow of fluid from the sprinkler.

To install the sprinkler, the support cup 170, which has a diameter of, e.g., 2.28 inches, is inserted in a cavity in the ceiling 1230 having a diameter of, e.g., about 2⅝ inches, and the threaded base 120 of the sprinkler is connected to the output fitting 1235 of a conduit 1240. The escutcheon 1210 and cover 1220 assembly is then installed in the support cup 170 so that the escutcheon flange 1215 rests on the outer surface of the ceiling 1230 (the outer surface of the cover is about 3/16 inches from the surface of the ceiling due to the gap between the flange and cover).

The support cup 170 and escutcheon 1210 are configured to allow for an adjustment to accommodate variations in the distance between the face 1250 of the conduit output fitting 1235 and the surface of the ceiling 1230, which is referred to as the "field adjustment." The field adjustment is sometimes needed, because the deflector 145 must be properly located below the ceiling 1230 in its deployed position, but it is difficult to precisely position sprinkler conduits 1240 with respect to the ceiling 1230 surface, due to the practicalities of building construction. To ensure the correct position of the deployed deflector 145, the distance between the face 1250 of the conduit output fitting 1235 and the ceiling 1230 should not be more than 2 inches.

The field adjustment is achieved by allowing the escutcheon 1210 to be positioned with a varying degree of overlap with the outer walls 175 of the support cup 170. The support cup 170 and escutcheon 1210 are configured so that any secure engagement between these components results in a proper position for the deployed deflector 145.

The amount of field adjustment, which in this example is 0.5 inches, is determined by the length of the rods 165 of the deflector support members 150, because the length of the rods 165 determines the amount of variation that can be accommodated in the position of the conduit 1240 relative to the ceiling line 1230. In other words, the rods 165 may be completely retracted within the housing member 155 before deployment, such as when the conduit 1240 and, therefore the sprinkler 100, is positioned as close as possible to the ceiling line 1230. Alternatively, the rods 165 may be nearly ¾ extended before deployment, such as when the conduit 1240 is positioned as far as possible above the ceiling line 1230. The length of the rods 165, in turn, determines the height of the outer walls 175 of the support cup 170. Thus, the outer walls 175 of the support cup 170 must have a height of slightly more than 0.5 inches in the example described herein.

Configuring the deflector support members 150 such that the rods 165 extend through the housing members 155 and the flange 140 allows for the use of a shallower cup, because the depth of the support cup is primarily determined by the length of the rods 165. This in turn results in the thermally-responsive element being located closer to the ceiling line, thereby improving sprinkler sensitivity. By contrast, in conventional concealed sprinklers, the guide pins coupled to the deflector are generally positioned below the flange, thereby requiring a deeper support cup (because the depth of the support cup is determined by the length of the guide pins plus the flange thickness). Consequently, the thermally-responsive element is located farther from the ceiling line, resulting in reduced sprinkler sensitivity.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims.

What is claimed is:

1. A fire protection sprinkler, comprising:

a body having an output orifice and a flange;

a seal cap to seal a flow of fluid from the output orifice;

a thermally-responsive element positioned to releasably retain the seal cap;

a plurality of housing members extending from the flange;

a plurality of rods, each rod slidably contained within one of the housing members and extending into the flange; and a deflector connected to ends of the rods, wherein each of the rods comprises at least one cylindrical portion and at least one frustoconical portion, and each of the housing members comprises at least one cylindrical portion and at least one frustoconical portion, and at least one frustoconical portion of the rod lodges in at least one frustoconical portion of the housing member.

2. The fire protection sprinkler of claim 1, wherein the thermally-responsive element comprises a pair of levers, each of which is connected to a soldered link.

3. The fire protection sprinkler of claim 1, wherein each of the rods slides between a first position within the housing member to a second, lower position extending from the housing member.

4. The fire protection sprinkler of claim 3, wherein, in the second position, the rods engage the housing members so as to assist in maintaining the deflector in a relatively stable position.

5. The fire protection sprinkler of claim 1, wherein the deflector comprises a conical portion facing the output orifice.

6. The fire protection sprinkler of claim 1, wherein the deflector comprises radial slots.

7. The fire protection sprinkler of claim 1, wherein at least two sides of the deflector are substantially linear.

8. The fire protection sprinkler of claim 1, wherein the deflector comprises tab portions with holes configured to receive ends of the rods, to connect the deflector to the rods.

9. The fire protection sprinkler of claim 1, further comprising a support cup having a substantially cylindrical outer surface, wherein the sprinkler is mounted in the support cup.

10. The fire protection sprinkler of claim 9, wherein a height of the outer surface of the support cup in an axial direction is less than a length of the rods.

11. The fire protection sprinkler of claim 9, further comprising:

a substantially cylindrical escutcheon installed in the support cup so as to surround the sprinkler, the escutcheon having a flange; and a substantially flat cover releasably mounted on the flange of the escutcheon, wherein the deflector moves from a first position to a second, lower position upon release of the cover.

* * * * *